US007033258B2

(12) United States Patent
Jordan

(10) Patent No.: US 7,033,258 B2
(45) Date of Patent: Apr. 25, 2006

(54) FLOOR RESURFACING DISKS FOR ROTARY FLOOR RESURFACING MACHINES

(75) Inventor: Todd A. Jordan, Tallmadge, OH (US)

(73) Assignee: Lite-Prep Surface Preparation Equipment, LLC, Tallmadge, OH (US)

( * ) Notice: Subject to any disclaimer, the term of this patent is extended or adjusted under 35 U.S.C. 154(b) by 0 days.

(21) Appl. No.: 10/655,902

(22) Filed: Sep. 5, 2003

(65) Prior Publication Data

US 2005/0054279 A1 Mar. 10, 2005

(51) Int. Cl.
*B24B 23/00* (2006.01)

(52) U.S. Cl. ..... 451/350; 451/353

(58) Field of Classification Search ..... 451/350, 451/353, 359, 434, 508, 514
See application file for complete search history.

(56) References Cited

U.S. PATENT DOCUMENTS

| | | | | | |
|---|---|---|---|---|---|
| 2,713,757 | A | * | 7/1955 | Brennecke | 451/353 |
| 2,923,107 | A | * | 2/1960 | Biasoni | 451/353 |
| 2,950,583 | A | | 8/1960 | Nilsson et al. | |
| 3,082,582 | A | | 3/1963 | Jeske | |
| 3,452,486 | A | * | 7/1969 | Lombardo et al. | 451/353 |
| 3,464,075 | A | | 9/1969 | Sullivan | |
| 3,631,635 | A | | 1/1972 | Vezner | |
| 3,924,362 | A | | 12/1975 | McAleer | |
| 4,138,804 | A | | 2/1979 | Thielen | |
| 4,608,727 | A | * | 9/1986 | Schwab | 15/98 |
| 4,747,176 | A | * | 5/1988 | Parks | 15/230.16 |
| 4,783,872 | A | * | 11/1988 | Burhoe | 15/98 |
| 5,054,245 | A | | 10/1991 | Coty | |
| 5,058,229 | A | | 10/1991 | Plazanet | |
| 5,170,595 | A | | 12/1992 | Wiand | |
| 5,259,085 | A | | 11/1993 | Marafante et al. | |
| 5,390,449 | A | | 2/1995 | Hilton | |
| 5,409,299 | A | | 4/1995 | Holder | |
| 5,454,751 | A | | 10/1995 | Wiand | |
| 5,507,061 | A | | 4/1996 | Miyazaki | |
| 5,579,554 | A | | 12/1996 | Plazanet | |
| 5,683,143 | A | | 11/1997 | Peterson et al. | |
| 5,806,132 | A | * | 9/1998 | Kelley | 15/230.17 |
| 5,863,241 | A | * | 1/1999 | Rottschy | 451/271 |
| 5,980,371 | A | * | 11/1999 | McConnell | 451/352 |
| 6,059,644 | A | | 5/2000 | Manor et al. | |
| 6,234,886 | B1 | * | 5/2001 | Rivard et al. | 451/353 |
| 6,261,164 | B1 | * | 7/2001 | Rivard et al. | 451/359 |

(Continued)

*Primary Examiner*—M. Rachuba
(74) *Attorney, Agent, or Firm*—Sand & Sebolt

(57) ABSTRACT

A resurfacing disk which mounts to a rotatable disk mount of a conventional rotary floor resurfacing machine. The resurfacing disk includes a rigid upper disk with four counterbored holes through an upper surface corresponding to four downwardly open holes of each disk mount. A resilient, flanged grommet is retained extending through corresponding holes of a retaining plate mounted to the upper surface. The grommets include respective vertically oriented longitudinal bores closely receive a mounting pin which extends from a corresponding hole of the disk mount. A plurality of rotary cutters each include a bracket which mounts to the upper disk opposite the grommets and an externally toothed cutter rotatably mounted thereto. The rotatable toothed cutters are oriented radially outwardly of the resurfacing disk so as to rotate while engaging the floor as the resurfacing disk spins with the disk mount. A resiliently deformable lower disk may be mounted in place of the rotary cutters and a sandpaper disk is removably affixed thereto using sheets interconnectable hook and a loop fastener material. The grommets and the lower disk deform to permit the floor resurfacing device to more closely follow contours of the floor surface and are easily replaceable if damaged or worn out.

27 Claims, 8 Drawing Sheets

U.S. PATENT DOCUMENTS * cited by examiner 6,287,181 B1 * 9/2001 Dekok et al. ..... 451/353
6,361,424 B1 * 3/2002 Manor et al. ..... 451/490

FLOOR RESURFACING DISKS FOR ROTARY FLOOR RESURFACING MACHINES

BACKGROUND OF THE INVENTION

1. Technical Field

Generally, the invention relates to a rotary floor prepping device. More particularly, the invention relates to a rotary floor prepping device which includes a substantially rigid upper disk with a resilient connector affixed at an upper surface thereof. A plurality of pins are used to removably mount the connector and upper disk to the rotary disk mount. One or more floor surfacing devices mount to the upper disk depending downwardly therefrom for prepping the floor surface. Specifically, the invention relates to a rotary resurfacing disk for removing material from a floor surface having a substantially rigid upper disk with a plurality of resilient, replaceable grommets affixed at an upper surface thereof. A plurality of pins are used to removably mount the grommets and upper disk to the rotary disk mount. One or more floor surfacing devices mount to the upper disk or to a resilient lower disk mounted below the upper disk depending downwardly therefrom for surfacing the floor surface as the resurfacing disk moves thereon.

2. Background Information

Various scraping, grinding, and sand blasting machines have been designed over the years to resurface floors necessitated due to wear and damage to floor surfaces over long periods of repeated and continuous use. For example, painted concrete floors are often resurfaced after the existing paint becomes chipped and the floor surface becomes pitted. Carpeting, linoleum tiles, and other floor coverings are often originally secured to the floor using an adhesive to prevent movement, but these floor coverings become worn, loose, or cracked over time. When these floor coverings are taken for replacement such as by using hand scrapers and other tools, the exposed floor surface with remaining floor covering and hardened adhesive is typically very rough. Before applying a new covering to the floor such as by repainting, applying linoleum tile, carpeting, or the like, it is usually required that any remaining paint, linoleum, carpet padding, or hardened adhesive of the previous floor covering be removed by resurfacing the floor.

One type of resurfacing machine often used to resurface floors is a small, hand-held grinding machine which utilizes grinding pads. The grinding machine is moved along the floor surface by an operator from a kneeling position on the floor surface. While these grinding machines are convenient to transport to the site where the floor to be resurfaced is located, they cover only a small surface area with each pass along the floor surface and thus require considerable time to grind or sand even small areas of the floor.

Larger wheeled resurfacing machines have thus been developed which utilize larger grinding pads or cutting blades to resurface larger areas of the floor more efficiently and expediently. Such resurfacing machines typically have a wheeled chassis supporting a motor which drives a rotary floor grinding mechanism and resurfacing disk. An upstanding push handle extends from the chassis to allow the operator to stand during operation rather than kneel. Thus, these resurfacing machines cover a much larger floor area with each pass and are easier to operate than the hand-held grinding machines.

One example of such a larger wheeled resurfacing machines is a multi-disk floor grinding machine disclosed in U.S. Pat. No. 6,238,277 issued to Duncan, et al. The floor grinding machine has a wheeled chassis which may be moved about the floor surface using an upstanding handle attached thereto. The chassis supports a bearing housing mounted on gimbals which pivot about an axis parallel to the floor surface to allow the bearing housing to vary in orientation to the floor surface as the floor grinding machine is moved across uneven floor surfaces. The bearing housing supports a main drive shaft which extends downwardly from the bearing housing rotatable relative thereto on bearings. A resurfacing disk mounting frame is rotatably mounted about the main drive shaft and is driven in rotation at a greatly reduced speed relative to the main drive shaft. The resurfacing disk mounting frame carries a plurality of disk mounts to which respective resurfacing disks in the form of grinding pads are mounted. The disk mounts and grinding pads are driven by the main drive shaft at an increased speed relative thereto. The grinding pads rotate about their own axes, and also about the axis of the main drive shaft so as to cover a larger floor area with each pass to reduce the time required to grind the floor surface.

While the larger wheeled resurfacing machines such as the multi-disk floor grinding machine of Duncan, et al. are easier to operate and cover more surface area per pass than the hand-held grinders, the resurfacing disks do not pivot adequately to allow the grinding pads to closely conform to the floor surface.

In an effort to improve this deficiency, some multi-disc floor grinding machines utilize a plurality of mounting pins to mount the resurfacing disks to the rotary disk mounts. The resurfacing disks include a rigid disk with a resilient connector affixed at an upper surface thereof. A plurality of the mounting pins, typically four disposed in a square pattern, fit in corresponding holes of the resilient connector to removably mount the connector and upper disk to the rotary disk mount. One or more downwardly dependent floor resurfacing devices mount to a lower surface of the upper disk for engaging the floor surface. The pins and the resilient connector allow the floor resurfacing devices to more closely follow the contours of the floor surface. While this arrangement is better than having a rigid connection between the disk mounts and the resurfacing disks, the resilient connector are prone to wear out overtime and are not readily replaceable.

A variety of other resurfacing disks and mounting arrangements have been developed for use with the rotary floor grinding machines which provide some degree of resiliency between the rotary disk mounts and the floor resurfacing devices. For example, in U.S. Pat. No. 5,259,085 issued to Marafante et al. is disclosed a floor cleaning disk for use in multi-disc floor treatment machines having three cleaning heads. A clip mechanism allows the disks to gimbal on uneven floor surfaces to allow better cleaning of such floor surfaces. U.S. Pat. No. 5,390,449 issued to Hilton discloses a sanding pad which includes a flexible foam material. The foam is positioned between a pad base and an abrasive surface which contacts the floor surface. When the sanding pad comes into contact with the floor surface, the foam deforms to maintain the abrasive surface in contact with the floor surface to provide even sanding thereof. In U.S. Pat. No. 3,924,362 issued to McAleer is disclosed a sanding pad which includes a rigid rotary member and a sanding layer, with a flexible foam layer of two different foam materials sandwiched therebetween. The foam layer comprise a core and an outer layer, one of the layers being made from a harder foam than the other. The harder foam layer helps to prevent the softer foam layer from being destroyed during sanding. U.S. Pat. No. 4,747,176 issued to Parks discloses a pad holder for a floor polisher which has flexible arms onto which a polishing surface is mounted. The flexible arms operate independently to permit the pad to polish uneven floor surfaces. In U.S. Pat. No. 5,683,143 issued to Peterson et al. is disclosed a disk which includes a plurality of abrading elements which are spring-mounted into the disk. The springs provide the flexibility needed for the disk to travel over uneven surfaces while allowing the abrading elements to stay in contact with the floor surface. Finally, U.S. Pat. No. 2,950,583 issued to Nilsson discloses disks which include a cushioning layer that is positioned between a body of the disk and an abrasive layer of surface treatment material. The cushioning layer has a series of annular rings or ribs made of plastic or rubber which yield to permit the abrasive layer to conform to the floor surface.

While these resurfacing disks and mounting arrangements may provide some degree of resiliency between the rotary disk mounts and the floor resurfacing devices, most are relatively complicated in design and are not built rugged enough for continuous use on industrial floor resurfacing machines.

Although these resurfacing disks and mounting arrangements are adequate for the purpose for which they were intended, they have the aforementioned shortcomings. Therefore, the need exists for an improved resurfacing disk for floor resurfacing machines which has resilient connectors mounted on a substantially rigid disk to pivot adequately for the floor resurfacing devices to conform to the floor surface. The resilient connectors would be individually replaceable in an easy manner to save time and money. The resurfacing disks would be relatively uncomplicated in design and built rugged enough for continuous use on industrial floor resurfacing machines.

BRIEF SUMMARY OF THE INVENTION

Objectives of the invention include providing a resurfacing disk which has improved conformance to the floor surface by having resilient connectors mounted on a substantially rigid disk to pivot allowing the floor resurfacing devices to conform to the floor surface.

Another objective is to provide a resurfacing disk in which the resilient connectors are individually replaceable in an easy manner to save time and money.

A still further objective of the invention is to provide such a resurfacing disk which is relatively uncomplicated in design and built rugged enough for continuous use on industrial refinishing machines, and which solves problems and satisfies needs existing in the art.

These objectives and advantages are obtained by the improved resurfacing disk removably mountable to a downwardly extending rotatable disk mount of a conventional rotary floor resurfacing machine to remove material from a floor surface of the present invention, the general nature of which may be stated as including: a substantially rigid upper disk having respective upper and lower surfaces; a plurality of resilient replaceable grommets each including an upper end adapted to removably mount to the disk mount and a lower end adapted to removably mount to the upper surface of the upper disk; and at least one floor resurfacing device removably mounted to the lower surface depending downwardly therefrom adapted for removing the material from the floor surface as the resurfacing disk moves thereon, the grommets deforming to permit the resurfacing devices to more closely follow contours of the floor surface.

A first preferred floor resurfacing device used one per resurfacing disk comprises a sanding disk which includes a sandpaper disk having a rough sanding surface for engaging the floor surface. A smooth back surface is removably affixable to the lower surface of the lower disk using respective sheets of an interconnectable hook and a loop fastener material. The hook and a loop fastener material is affixed the lower surface of the lower disk and to the back surface of the sandpaper disk to removably affix the sanding disk to the lower disk.

A second preferred floor resurfacing device used three per resurfacing disk comprises a rotary cutter which includes a bracket which has a base plate mountable to the lower surface of the upper disk. A pair of downwardly dependent tabs each have a hole therethrough. A generally cylindrical cutter is rotatably mounted to the bracket on an axle which extends through the tabs and the rotary cutter. The cutter has a plurality of radially extending cutting teeth disposed about a rotational axis along the axle.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DETAILED DESCRIPTION OF THE INVENTION

Figure 1:
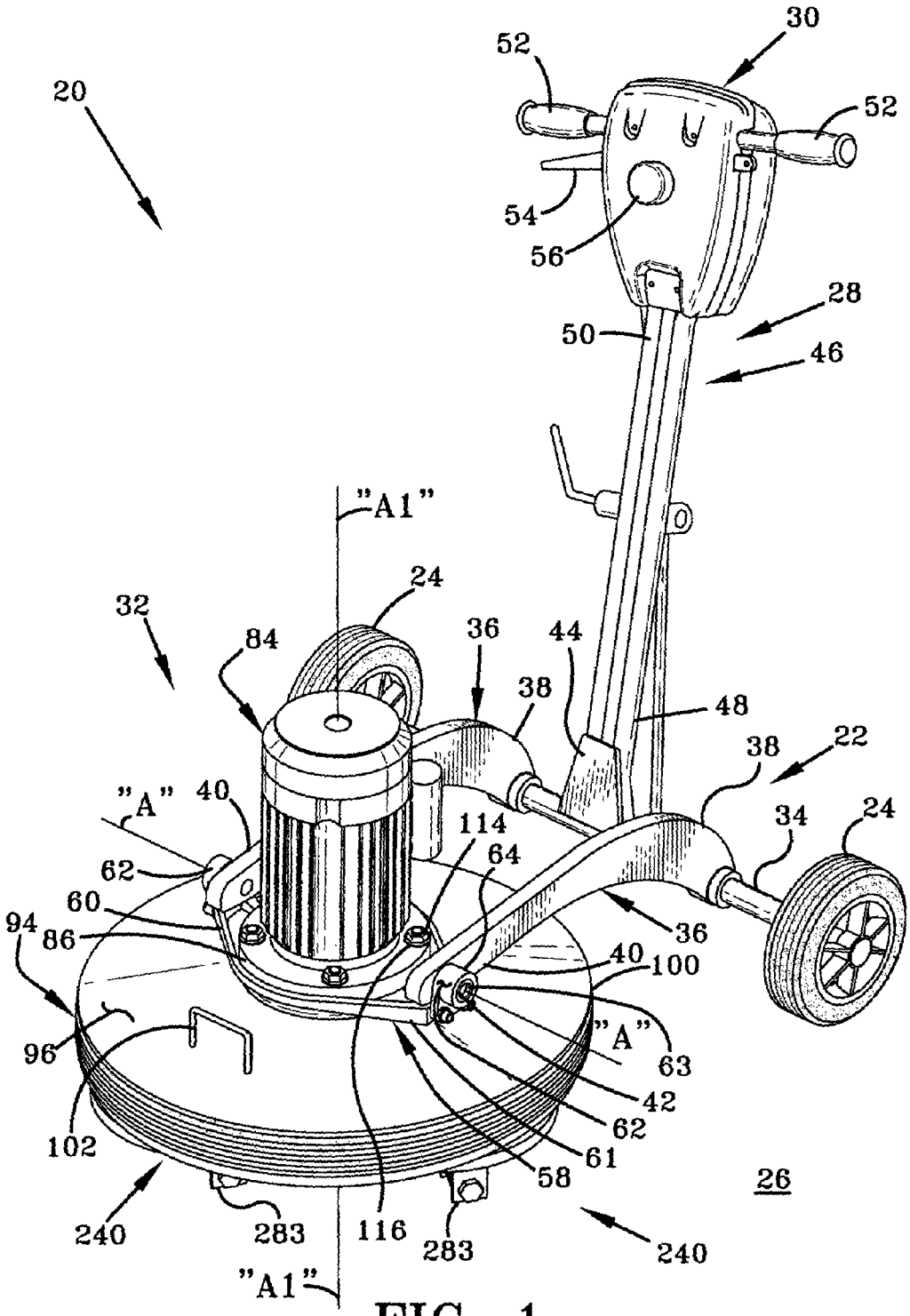
FIG. 1 is a perspective view of a floor resurfacing machine having a pivotal resurfacing assembly as used with a first embodiment of the resurfacing disk of the present invention comprising a resurfacing disk.

FIG. 1 shows a multi-disc rotary floor surfacing machine for removing material from a floor surface, indicated generally at 20, for use with the floor surfacing disks of the present invention. The resurfacing machine 20 includes a wheeled chassis 22 with a plurality of wheels 24 mounted to the chassis 22 for supporting and facilitating rolling along the floor surface 26, an upstanding handle 28 secured to the chassis 22 for manually controlling the movement of the resurfacing machine 20 on the wheels 24, a control console 30 secured to the handle 28 for controlling the operation of the resurfacing machine 20, and a pivotable resurfacing assembly 32 for following the contours of the floor surface 26 and removing material therefrom.

The chassis 22 includes a transverse axle tube 34 through which an axle (not shown) extends supporting the wheels 24 that are coaxially aligned with each other affixed to opposite ends of the axle. A pair of curved side plates 36 include respective proximal ends 38 which are affixed to the axle tube 34, and respective distal ends 40 to which respective outwardly extending transverse pivot pins 42 are affixed. A support plate 44 is affixed to axle tube 34 between the side plates 36.

The handle 28 includes a main tube 46 having a lower end 48 affixed to the axle tube 34 and support plate 44, and an upper end 50 with a pair of transverse hand grips 52. The control console 30 is secured to the upper end 50 of main tube 46 and includes a control lever 54 and rotary switch 56 for controlling the operation of resurfacing machine 20.

Figure 2A:
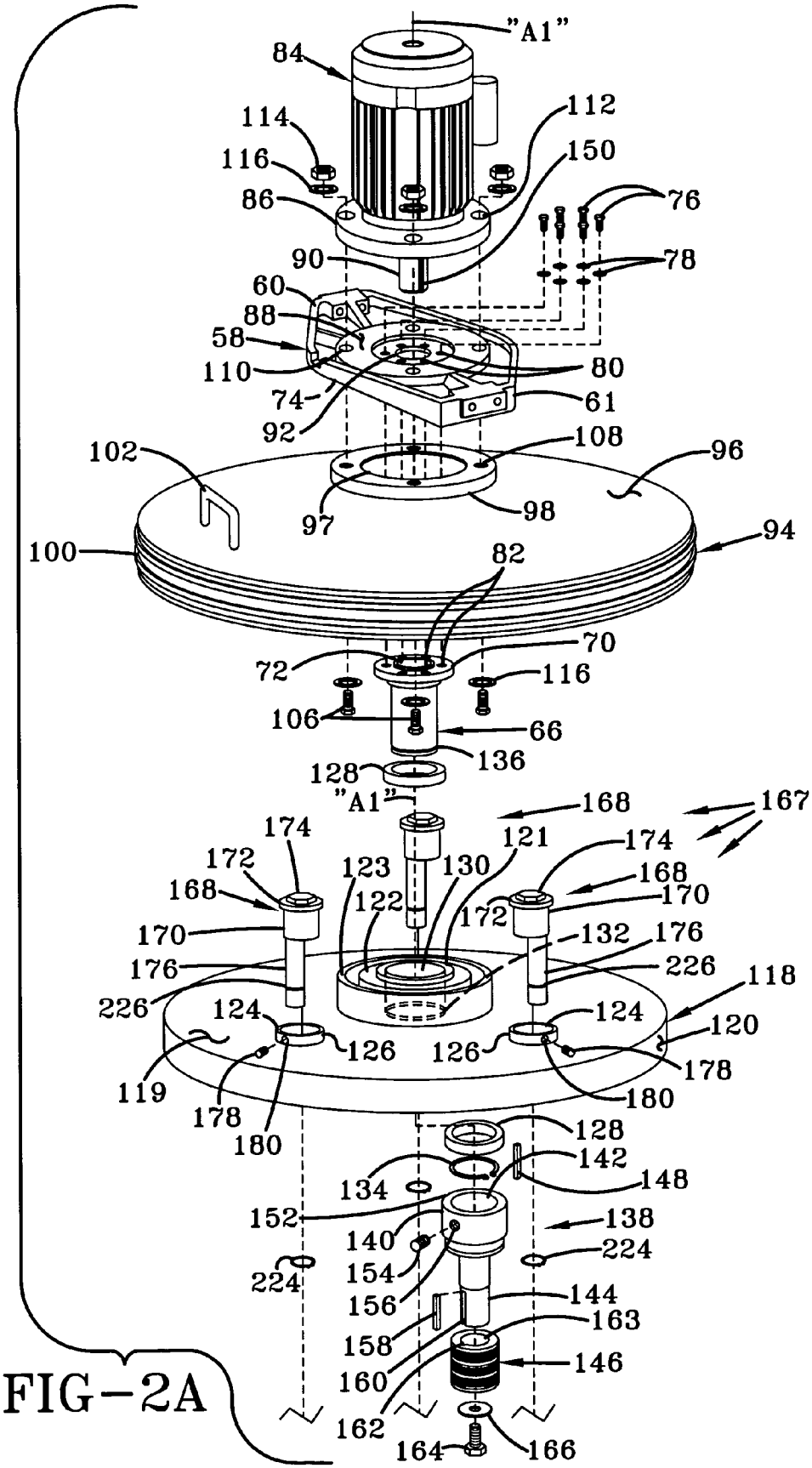
FIG. 2A is an upper half exploded perspective view of a pivotal resurfacing assembly and the resurfacing disk.
Figure 2B:
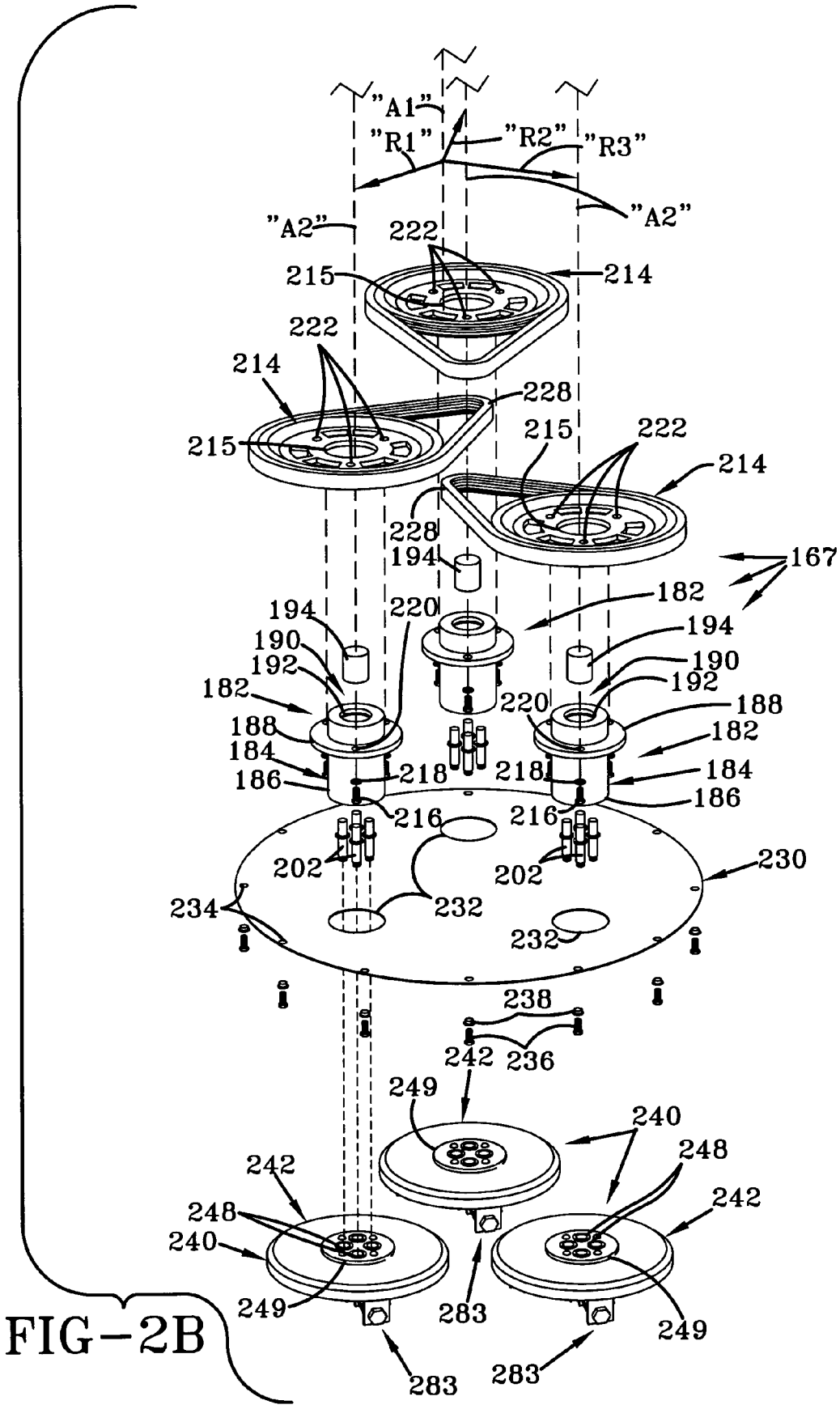
FIG. 2B is a lower half exploded perspective view of the pivotal resurfacing assembly and the resurfacing disk.
Figure 3:
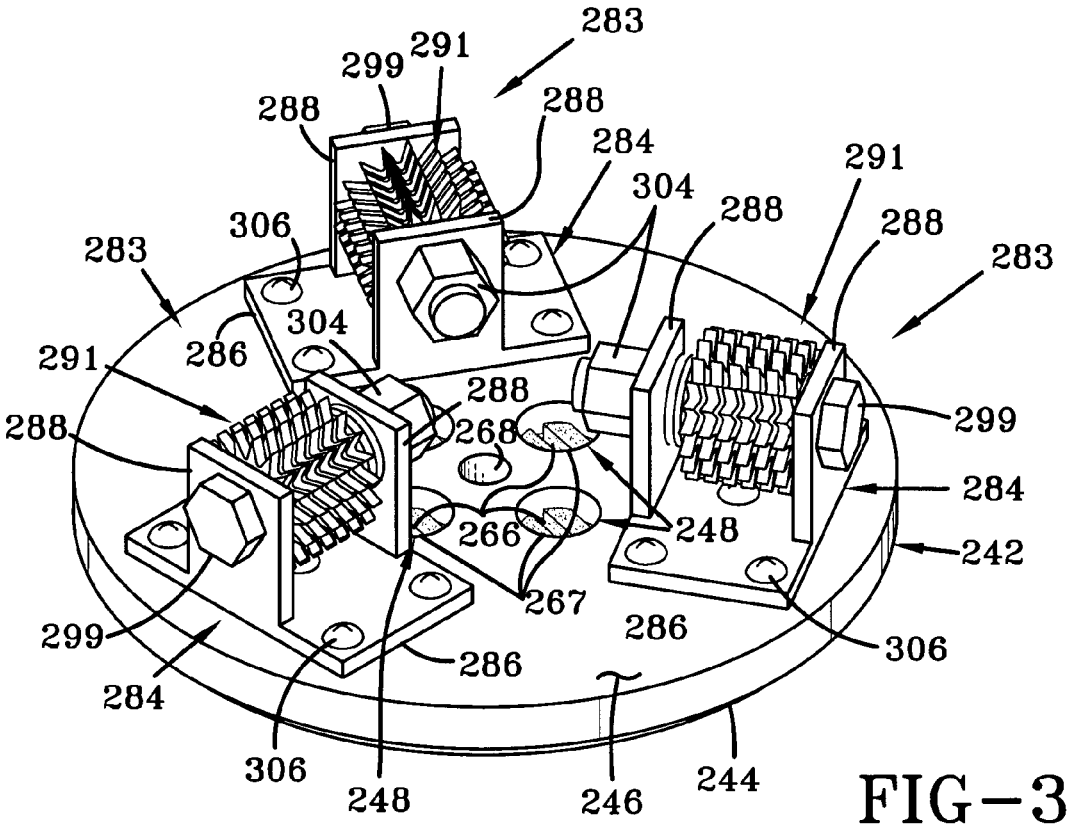
FIG. 3 is a perspective view of the resurfacing disk.
Figure 4:
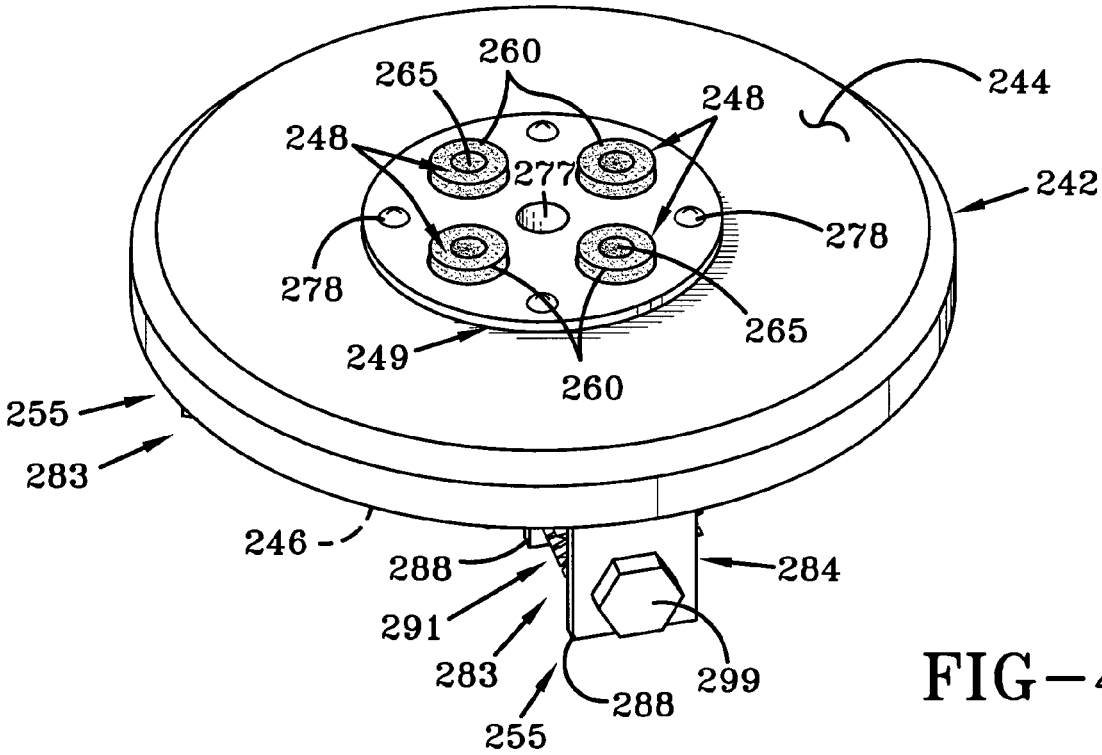
FIG. 4 is a perspective view of the resurfacing disk.
Figure 5:
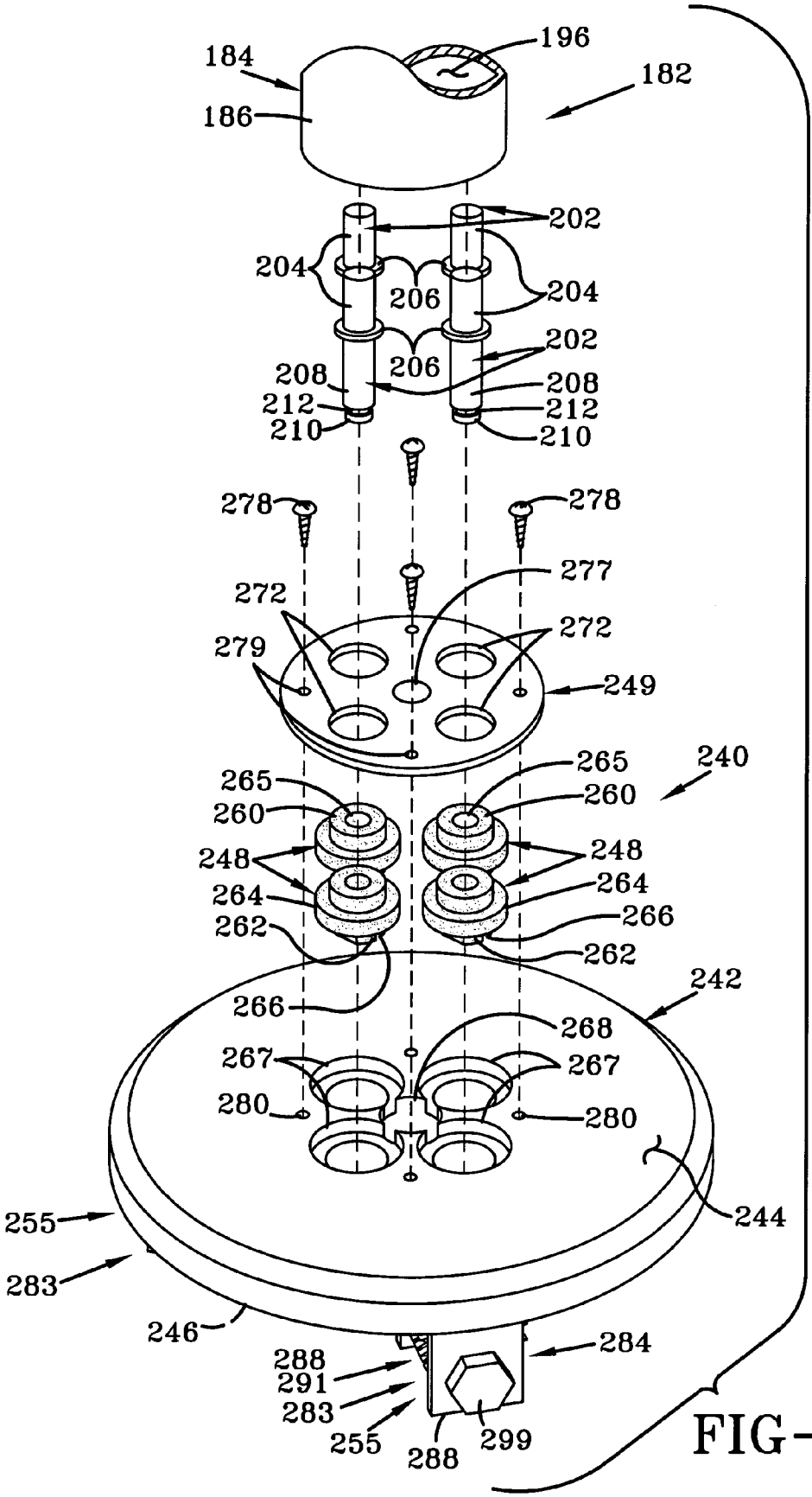
FIG. 5 is an exploded perspective view of the resurfacing disk, additionally including a plurality of mounting pins and a portion of a disk mount of the floor resurfacing machine.
Figure 6:
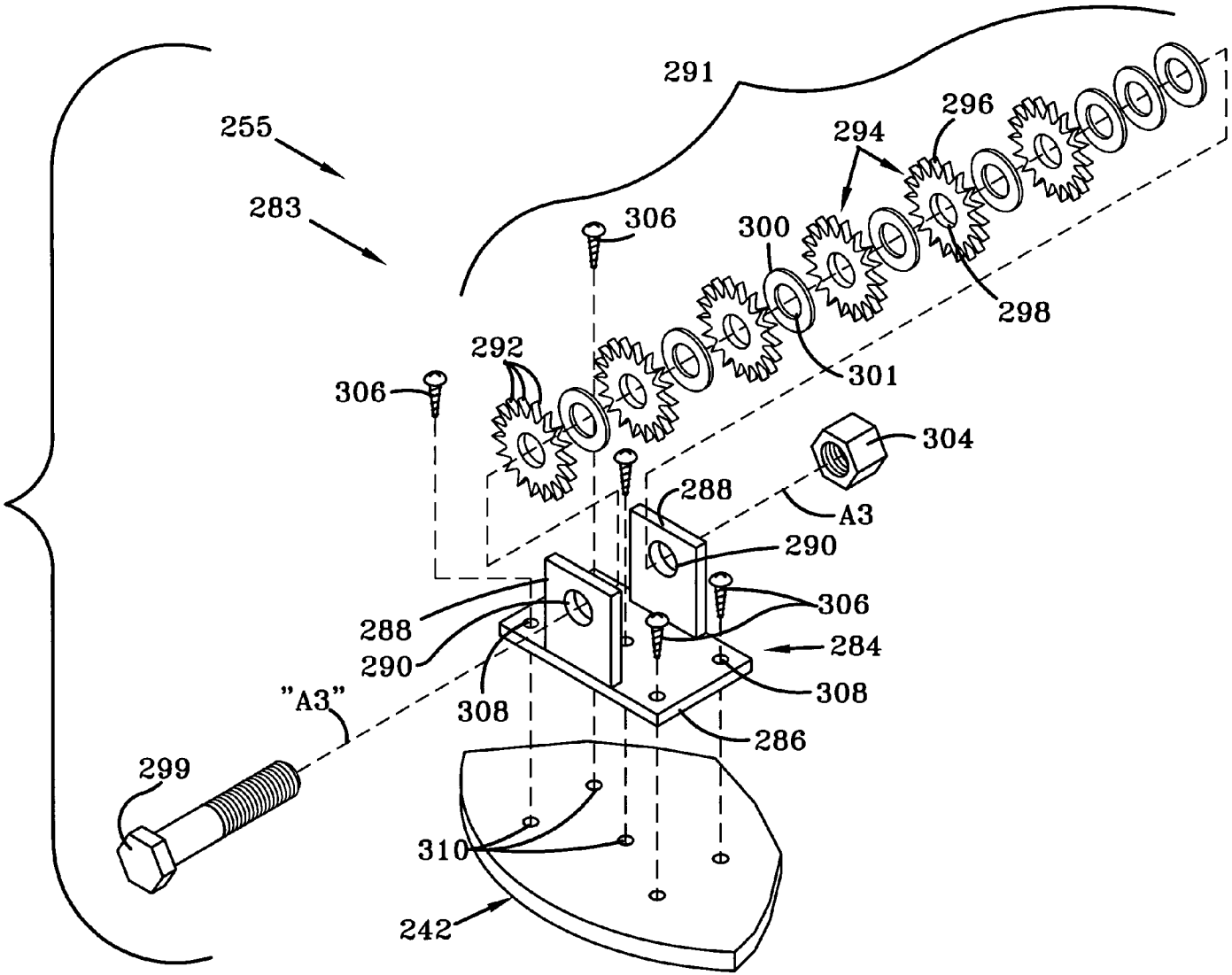
FIG. 6 is an exploded perspective view of the resurfacing disk.

As best shown in FIGS. 2A and 2B, the resurfacing assembly 32 includes a mounting frame or pivot plate 58 which is pivotally supported on the chassis 22 for movement about a horizontal pivot axis "A" parallel to the floor surface 26 to accommodate uneven floor surfaces 26. The pivot plate 58 has opposite ends 60 and 61 which are pivotally connected to the side plates 36 using a pair of pivot castings 62 with respective holes 63 and bushings 64 bolted thereto which fit over the pivot pins 42. A central mount 66 includes a cylindrical body 68, a dependent annular flange 70, and a longitudinal bore 72 therethrough, being bolted to a lower mounting surface 74 of the pivot plate 58 using a plurality of screws 76 and washers 78 which extend through respective clearance holes 80 through pivot plate 58 to thread into corresponding threaded holes 82 in central mount 66. A power source in the form of a conventional electric motor 84 is mounted to the pivot plate 58 at a mounting flange 86 thereof in an upright position with a downwardly extending drive shaft 90 which is rotatable about a vertically disposed main axis "A1" extending through a central hole 92 of pivot plate 58. An electric cord (not shown) plugs into conventional electrical outlets to provide electrical power to motor 84.

A circular housing 94 is mounted to the pivot plate 58 below the motor 84 coaxially disposed about the main axis "A1". The housing 94 includes a circular plate 96 with a central hole 97 surrounded by a flange 98, and a peripheral skirt 100 extends downwardly from the plate 96 towards the floor surface 26 to confine and collect dust, dirt, grit, and other debris. A U-shaped lifting handle 102 extends upwardly from plate 96 to facilitate lifting thereof. The motor 84 and housing 94 are respectively mounted to the upper mounting surface 88 and a lower mounting surface 104 of pivot plate 58 using a plurality of bolts 106 which extend through respective clearance holes 108 of flange 98 of housing 94, through respective clearance holes 110 of pivot plate 58, and through respective clearance holes 112 of mounting flange 86 of motor 84, being secured by respective nuts 114 and washers 116.

A circular resurfacing disk support 118 is mounted to the pivot plate 58 therebelow for rotation relative thereto about the main axis "A1". The resurfacing disk support 118 includes a circular plate 119 and a downwardly dependent peripheral wall 120, a central bore 121 through plate 119 which closely fits about the body 68 of central mount 66 which is surrounded by an inner flange 122 and an outer flange 123, with a trio of spaced bores 124 each surrounded by a flange 126. The resurfacing disk support 118 is coaxially mounted to the drive shaft 90 of motor 84 concealed within the skirt 100 for rotation relative to the housing 94 by a pair of sealed ball bearing 128 which press-fit into respective oppositely disposed larger diameter annular bearing retention spaces 130 and 132 of central bore 121. The resurfacing disk support 118 is retained to freely rotate about the central mount 66 by an external snap ring 134 which closely fits to a mating external groove 136 of body 68 engaging a lowermost of bearings 128.

The resurfacing assembly 32 further includes a main drive shaft 138 coaxially connected to the drive shaft 90 of motor 84 extending therefrom, having an upper end 140 with a bore 142 sized to closely receive the drive shaft 90, and a solid cylindrical lower end 144 sized to receive a conventional tri-pulley 146. The upper end 140 fits within the longitudinal bore 72 of central mount 66 to engage drive shaft 90. The upper end 140 is rotationally affixed to drive shaft 90 using a key 148 which fits into a groove 150 of the drive shaft 90 and a groove 152 of the main drive shaft 138. A set screw 154 extends through a threaded hole 156 of main drive shaft 138 to longitudinally retain the main drive shaft 138 to the drive shaft 90. The tri-pulley 146 is rotationally affixed to main drive shaft 138 using a key 158 which fits into a groove 160 of the main drive shaft 138 and a groove 162 in a bore 163 through of the tri-pulley 146. A bolt 164 longitudinally threads into lower end 144 and along with a flat washer 166 longitudinally retains the tri-pulley 146 to the main drive shaft 138.

The resurfacing disk support 118 includes a plurality of disk mounts 167, typically three, extending downwardly from plate 119 for rotation relative thereto about respective resurfacing disk axes "A2" disposed parallel to and radially spaced from the main axis "A1", each disk mount 167 being adapted to mount a resurfacing disk (see below). The disk mounts 167 include respective stub shafts 168, each having a cylindrical upper end 170 which closely fits within respective of the spaced bores 124 which includes a flange 172 and a hex head 174, and a cylindrical offset lower end 176. The stub shafts 168 are retainable in a desired rotational position within respective of the spaced bores 124 with the offset lower ends 176 positioned at a radius "R1"–"R3" more inwardly or outwardly from central bore 121 of rotary support 118 than spaced bores 124 by set screws 178 which extend through respective threaded holes 180 through flanges 126 to engage the respective upper ends 170.

The disk mounts 167 further include respective disk mount assemblies 182 each comprising a disk mount 184 each of which includes a cylindrical body 186, a dependent annular flange 188, and a longitudinal bore 190 therethrough. An upper end 192 of bore 190 has a bushing 194 pressfit therein sized to closely rotationally receive the lower ends 176 of stub shafts 168. A lower end 196 of bore 190 is of a larger diameter defining a shoulder (not shown) therebetween. A circular disk 198 of disk mount assembly 182 is affixed within lower end 196 of bore 190. The disk 198 typically has four downwardly open, mounting pin receiving holes 200 of circular cross-section disposed in a square pattern.

A plurality of disk mounting pins 202 of circular cross-section each include an upper end 204 adapted to closely fit within a corresponding hole 200 of the disk mounts 167 such as by press-fitting therein. The mounting pins 202 each have an annular middle flange 206 adapted to engage the disk 198 of disk mount assembly 182 to limit movement of the mounting pins 202 into the holes 200. A dependent lower end 208 of each mounting pin 202 includes a head 210 defined by an annular groove 212 adapted to receive an optional external retaining clip (not shown). The mounting pins 202 are typically made of tubular metal or solid plastic such as polypropylene or polyvinyl chloride.

A resurfacing disk drive mechanism 213 is coupled to the main drive shaft 138 and to the disk mounts 167 to transfer power therebetween. A trio of conventional pulleys 214 are respectively bolted to the flanges 188 with upper end 186 closely fitting through respective center holes 215 using a plurality of screws 216 with washers 218 which extend through respective clearance holes 220 of flanges 188 and threadably engage respective threaded holes 222 of the pulleys 214. The offset lower ends 176 of stub shafts 168 closely rotationally fit within the respective upper ends 192 of longitudinal bores 190 of disk mounts 184, being retained for rotation therewithin by respective external snap rings 224 which closely fit to respective external grooves 226 of the offset lower ends 176, the snap rings 224 abutting the shoulder of disk mounts 182. A plurality of V-belts 228 interconnect the tri-pulley 146 to the respective pulleys 214. The resurfacing disk drive mechanism 213 coupled to the main drive shaft 138 and to the disk mounts 167 transfers power from the drive shaft 90 of motor 84, through main drive shaft 138 to and pulley 146 to the disk mounts 167 and the resurfacing disk support 118. The disk mounts 167 rotate about the resurfacing disk axes "A2" in a first rotational direction (arrow "R") and the resurfacing disk support 118 simultaneously rotates about the main axis "A1" in an opposite rotational direction (arrow "R1") carrying said disk mounts 167 therewith. This occurs because the resurfacing disk support 118 is freely rotationally mounted to the housing 94 independently of main drive shaft 138 such that the force of the V-belts 228 rotating the disk mounts 167 is transmitted to the resurfacing disk support 118 to rotate the resurfacing disk support 118 about the main axis "A1", but at a greatly reduced speed compared to the speed of rotation of the main drive shaft 138.

A circular dust shield 230 made of thin sheet metal includes a trio of spaced clearance holes 232 for the disk mount assemblies 182. The dust shield 230 includes a plurality of peripheral clearance holes 234 and is mounted to the resurfacing disk support 118 using a plurality of screws 236 with washers 238 which threadably engage respective peripheral threaded holes (not shown) of the peripheral wall 120 of the resurfacing disk support 118. The dust shield 230 helps to protect the pulleys 146 and 214, and the V-belts 228 from dust and the like generated during operation of floor resurfacing machine 20.

In accordance with the invention, a first embodiment of the resurfacing disk of the present invention is shown in FIGS. 3–6, and is indicated generally at 240, which is provided for each disk mount 167. The resurfacing device 240 is removably mountable to each disk mount 167 using a plurality of the mounting pins 202, typically four for each disk mount 167, in a spaced relationship for rotation therewith about respective of the resurfacing device axes "A2" and about the main axis "A1". Each resurfacing device 240 includes a substantially rigid upper disk 242 having respective upper and lower surfaces 244 and 246, a resilient replaceable grommet 248 for each mounting pin 202, a retaining device comprising a retaining plate 249 of circular shape, and at least one resurfacing device 255 removably mounted to the lower surface 246 of the upper disk 242 depending downwardly therefrom adapted for removing the material from the floor surface 26 as said resurfacing devices 240 move thereon. The upper disk 240 is typically made of a plastic material, such as polypropylene or polyvinyl chloride, or even metals such as steel or aluminum which are coated with plating, anodizing, or painted may also be used.

The grommets 248 each include an upper end 260 adapted to removably mount to the upper disk mounts 167, a dependent lower end 262 adapted to removably mount to the upper surface 244 of the upper disk 242, and a middle flange 264 disposed therebetween of a larger outer size than the upper end 260. The grommets 248 are of circular cross-section with a longitudinal bore 265 extending therethrough also of circular cross-section within which the lower end 208 of mounting pins 202 are detachably engageable. The lower ends 262 of grommets 248 include a transverse slot 266 to accommodate the retaining clips used to retain mounting pins 202 within grommets 248. The lower ends 262 and middle flanges 264 closely fit within respective counter-bored holes 267 through upper surface 244, typically being symmetrically disposed about a centering hole 268 which is centrally disposed on upper disk 242 in a square pattern corresponding to holes 200 of disk mount assembly 182. The grommets 248 are typically made of resilient rubber and similar suitable materials may also be used.

The retaining plate 249 is typically made of a sheet steel or aluminum which is coated with plating, anodizing, or painted, and has a plurality of holes 272 of circular cross-section adapted to closely pass the upper ends 260 of the grommets 248. The holes 272 are typically disposed in a square pattern corresponding to holes 200 of disk mounts 167. The retaining plate 249 includes a centering post 274 centrally disposed thereon comprising a centering flange 276 disposed about a centering hole 277 defined by the centering flange 276. The centering flange 276 closely fits within the centering hole 268 of upper disk 242 to center retaining plate 249 with holes 272 to the upper disk 242. The retaining plate 249 is removably mountable to the upper surface 244 of the upper disk 242 to retain the grommets 248 to the upper disk 242. The upper ends 260 of grommets 248 closely fit within the holes 272 of retaining plate 249. The retaining plate 249 is mountable to the upper disk 242 using a plurality of screws 278 which extend through respective clearance holes 279 of retaining plate 249 and threadably engage respective threaded holes 280 in upper disk 242. The mounting pins 202 extend into respective of the bores 265 of grommets 248. The grommets 248 deform to permit the floor resurfacing devices 255 to more closely follow contours of the floor surface 26.

The floor resurfacing device 255 includes a plurality of rotary cutters 283 each of which includes a metal bracket 284 mountable to the lower surface 246 of the upper disk 242, comprised of a base plate 286 and a pair of downwardly dependent tabs 288 having respective holes 290 therethrough. A generally cylindrical metal cutter 291 is rotatably mounted to the bracket 284 having a plurality of radially extending cutting teeth 292 disposed about a rotational axis "A2" which is oriented radially outwardly from the resurfacing device axis "A2" so as to rotate therearound during resurfacing device rotation. The cylindrical cutter 291 includes a plurality of individual cutting wheels 294 having an outer periphery 296 with a plurality of cutting teeth 292 and a central bore 298 adapted to closely receive an axle comprising a bolt 299 therethrough. The cutting wheels 294 are typically made of case hardened sheet steel to provide wear resistance for cutting teeth 292. Likewise, the cutting teeth 292 may be made of carbide or other suitably hard material affixed to the outer periphery 296 of cutting wheels 294. A plurality of spacers comprise flat washers 300 having a center bore 301 adapted to closely receive the bolt 299. The washers 300 are interposed between the cutting wheels 294 to provide separation of the cutting wheels 294, the cutting wheels 294 and the washers 300 being rotatably disposed along the bolt 299 between the tabs 288. The bolt 299 extends through the holes 290 of the tabs 288 along the rotational axis "A2", through central bore 298 of cutting wheels 294, and through washers 300, the cylindrical cutter 291 being secured thereon by a nut 304. The rotary cutters 283 are removably affixed to the upper disk 242 using a plurality of round head screws 306 which extend upwardly through respective clearance holes 308 of base plate 286 threading into respective threaded holes 310 of upper disk 242. The floor resurfacing device 255 is primarily for use removing brittle materials such as grout from the floor surface 26.

The resurfacing devices 240 are removably mountable to the disk mounts 167 using the mounting pins 202 the lower ends 208 of pins 202 which are detachably engageable into the bores 265 of grommets 248. The optional retaining clips may be engaged in the annular groove 212 of each mounting pin 202 disposed within the transverse slots 266 of grommets 248 to retain mounting pins 202 within grommets 248. The grommets 248 deform during use of the floor resurfacing machine 20 to permit the floor resurfacing devices 255 to more closely follow contours of the floor surface 26. Likewise, the grommets 248 are easily replaceable by removing the retaining plate 249.

Figure 7:
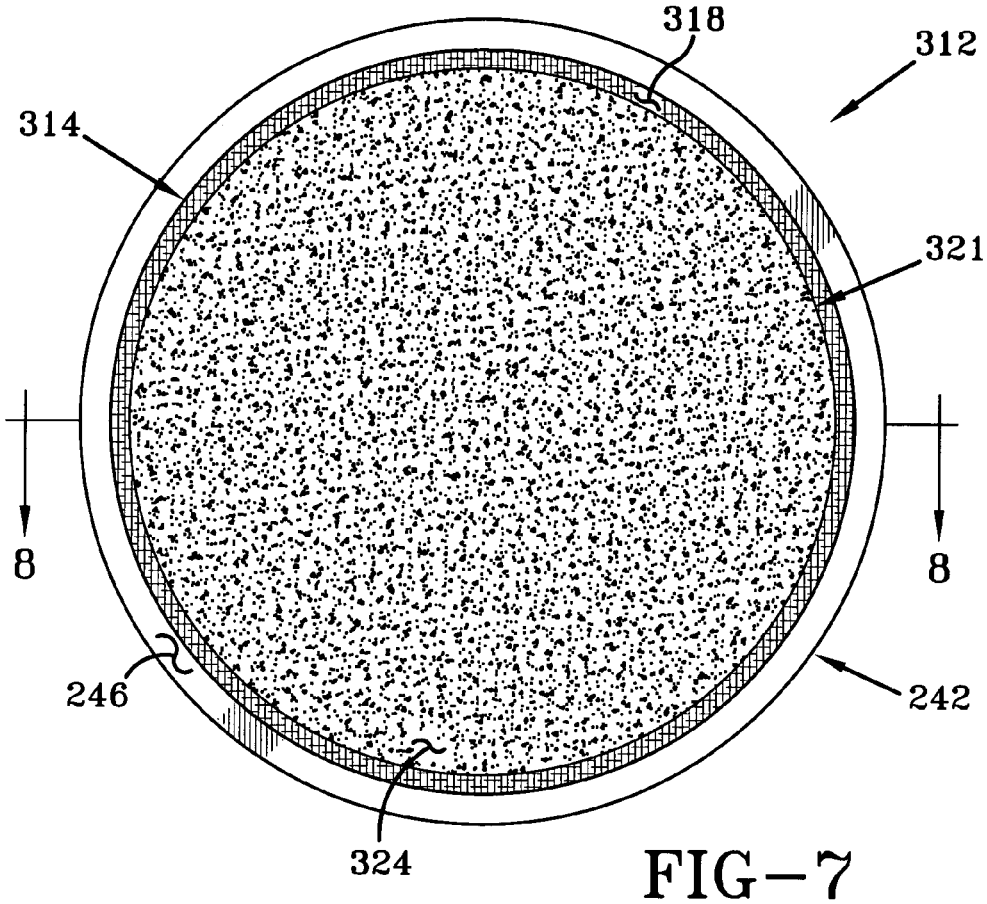
FIG. 7 is a bottom plan view of a second embodiment of the resurfacing disk of the present invention comprising a sanding disk.
Figure 8:
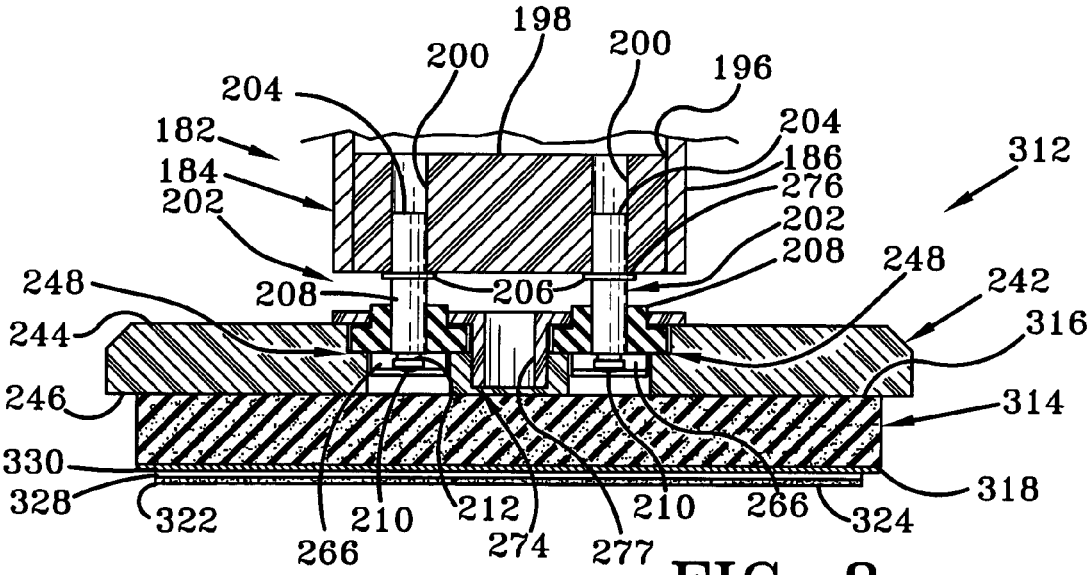
FIG. 8 is a vertical sectional view of the sanding disk taken along line 8—8, FIG. 7, additionally including a plurality of the mounting pins and a fragmentary vertical section of the disk mount of the floor resurfacing machine.
Figure 9:
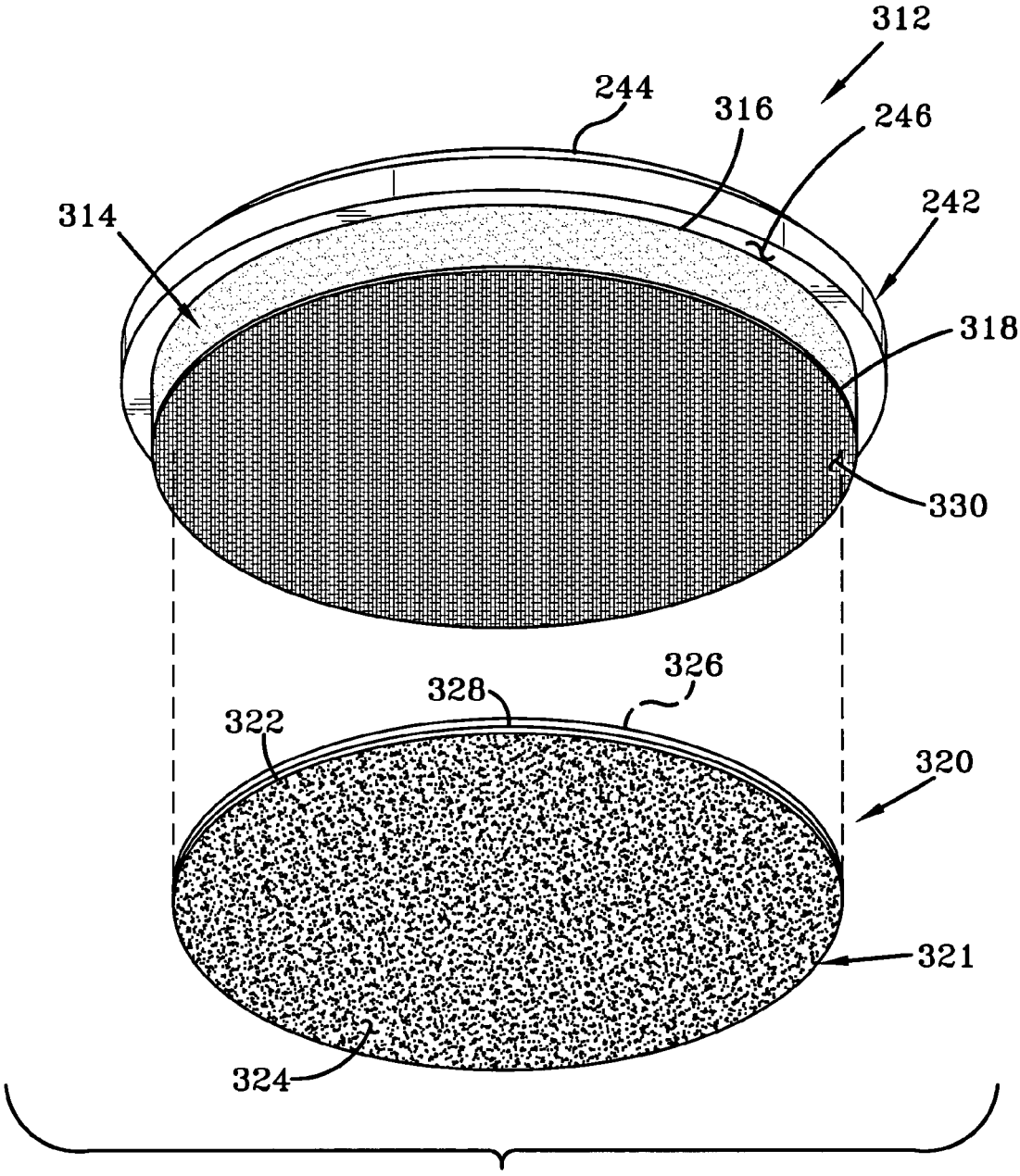
FIG. 9 is a perspective view of the sanding disk with a sandpaper disk thereof exploded away.

A second embodiment of the resurfacing disk of the present invention is indicated at 312 in FIGS. 7–9, which is provided for each disk mount 167. The resurfacing device 312 is removably mountable to each disk mount 167 using a plurality of the mounting pins 202, typically four for each disk mount 167, in a spaced relationship for rotation therewith about respective of the resurfacing device axes "A2" and about the main axis "A1". Each resurfacing device 312 includes the substantially rigid upper disk 242 having the respective upper and lower surfaces 244 and 246, the resilient replaceable grommets 248 for each mounting pin 202, the retaining plate 249, a resiliently deformable lower disk 314, which is made of semi-rigid hard sponge material having an upper surface 316 adhesively or otherwise mounted to the lower surface 246 of the upper disk 242 and a lower surface 318, and at least one floor resurfacing device 320 removably mounted to the lower surface 318 of the lower disk 314 depending downwardly therefrom adapted for removing the material from the floor surface 26 as resurfacing devices 312 move thereon. In accordance with the invention, the lower disk 314 deforms during use to permit the floor resurfacing device 320 to more closely follow contours of the floor surface 26.

The floor resurfacing device 320, shown in FIGS. 7–9, comprises a sanding disk 321 which includes a sandpaper disk 322 having a rough sanding surface 324 for engaging the floor surface 26 and a smooth back surface 326 removably affixable to the lower surface 318 of the lower disk 314. The sandpaper disk 322 is removably affixable to the lower surface 318 of the lower disk 314 using respective hook and loop disks 328 and 330 cut from sheets of an interconnectable hook and a loop fastener material, such as the commonly known under the trade name Velcro™, adhesively affixed respectively to the lower surface 318 of the lower disk 314 and to back surface 326 of the sandpaper disk 322. The hook disk 328 is typically affixed to the back surface 326 of the sandpaper disk 322 and the loop disk 330 is affixed to the lower surface 318 of the lower disk 314 rather than vice-versa since the loop fastener material is more prone to wear out first than the hook fastener material due to flexing of the hooks. This lowers the incidence of scraping off the loop fastener material from the lower disk 314.

The resurfacing devices 312 are removably mountable to the disk mounts 167 using the mounting pins 202 the lower ends 208 of mounting pins 202 which are detachably engageable into the bores 265 of grommets 248. The optional retaining clips may be engaged in the annular groove 212 of each mounting pin 202 disposed within transverse slots 266 of grommets 248 to retain mounting pins 202 within grommets 248. The grommets 248 and the lower disks 314 deform during use of the floor resurfacing machine 20 to permit the floor resurfacing device 320 to more closely follow contours of the floor surface 26. Likewise, the grommets 248 are easily replaceable by removing the retaining plate 249.

The resurfacing disks 240 and 312 flex at the resilient grommets 248. The resurfacing disk 312 additionally flexes at the resilient lower disk 314. These features allow the floor resurfacing devices 255 to conform to the floor surface 26 unlike prior art floor surfacing devices. Therefore, the floor resurfacing devices 255 remain in full contact with the floor surface 26 regardless of encountering uneven areas of the floor surface 26 to grind flush any surface imperfections. Likewise, the edges of the floor resurfacing devices 255 remain in full contact with the floor surface 26 and are not lifted or oriented so as to dig into the floor surface 26 as the wheels 24 roll over the uneven areas of the floor surface 26.

It is understood that various other floor resurfacing devices other than the rotary cutters and the sanding disk shown may be used such as those which are adapted for scrubbing, sanding, scarifying, and paint removal. Such resurfacing devices include, but are not limited to diamond disks to grind concrete floor surfaces, polypropylene scrub brushes, nylon scrub brushes, medium and heavy duty wire brushes, non-sparking wire brushes, carbide floor scrapers, inner and outer coarse grind diamond blades, inner and outer smooth grind diamond blades, pad drivers with scrub pads, and other grit disks.

Accordingly, the resurfacing disks have improved conformance to the floor surface by including resilient connectors and a resilient lower disk which pivot to allow the floor resurfacing devices to conform to the floor surface, the resilient connectors are individually replaceable in an easy manner to save time and money, and the resurfacing disks are relatively uncomplicated in design and built rugged enough for continuous use on industrial floor resurfacing machines which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved floor resurfacing disk is constructed and used, the characteristics of the construction, and the advantageous, new and useful results obtained; the new and useful structures, devices, elements, arrangements, parts and combinations, are set forth in the appended claims.

The invention claimed is:

1. A resurfacing disk removably mountable to a downwardly extending rotatable disk mount of a conventional rotary floor resurfacing machine to remove material from a floor surface, the resurfacing disk comprising:

a substantially rigid upper disk having respective upper and lower surfaces; and having a plurality of spaced holes formed in the upper surface;

a connector mechanism for connecting the upper disk to the disk mount; the connector mechanism comprising:

a plurality of resilient replaceable grommets; each grommet including a lower end complementary sized and shaped to be tightly received within one of the holes in said upper disk; and a plurality of mounting pins; each pin having a lower end that is received within a bore of one of the grommets, and an upper end that connects to the disk mount; and at least one floor resurfacing device removably mounted to said lower surface of the upper disk and depending downwardly therefrom; said resurfacing device being adapted for removing the material from the floor surface as said resurfacing disk moves thereon;

and wherein said grommets are individually deformable as the resurfacing device moves over the floor surface and encounters changes in the contours thereof; thereby permitting said resurfacing device to more closely follow the contours of the floor surface.

2. The resurfacing disk defined in claim 1, further comprising a resiliently deformable lower disk mounted to the lower surface of the upper disk, the floor resurfacing device being removably mounted to a lower surface of said lower disk depending downwardly therefrom, said lower disk deforming to permit said floor resurfacing devices to more closely follow contours of the floor surface.

3. The resurfacing disk defined in claim 2 in which the floor resurfacing devices each comprise a sanding disk which includes a sandpaper disk having a rough sanding surface for engaging the floor surface and a smooth back surface removably affixable to the lower surface of the lower disk.

4. The resurfacing disk defined in claim 2 in which the floor resurfacing devices are removably affixable to the lower surface of the lower disk using respective disks of an interconnectable hook and a loop fastener material affixed the lower surface of the lower disk and to a back surface of the floor resurfacing devices.

5. The resurfacing disk defined in claim 4 in which the disk of hook fastener material is affixed to the back surface of the floor resurfacing devices and the disk of loop fastener material is affixed to the lower surface of the lower disk.

6. The resurfacing disk defined in claim 1 in which the floor resurfacing devices comprise rotary cutters each including a bracket mountable to the lower surface of the lower disk, and a generally cylindrical cutter rotatably mounted to said bracket having a plurality of radially extending cutting teeth disposed about a rotational axis which is oriented radially outwardly from the resurfacing disk axis so as to rotate therearound during resurfacing disk rotation.

7. The resurfacing disk defined in claim 6 in which the brackets include a base plate and a pair of downwardly dependent tabs having respective holes therethrough, the cylindrical cutter being mounted thereto on an axle which extends through said tabs and said cylindrical cutter.

8. The resurfacing disk defined in claim 7 in which the axle comprises a rod which extends through the holes of the tabs, said rotary cutter being secured thereon by a fastener attached to said rod.

9. The resurfacing disk defined in claim 6 in which the rotary cutters include a plurality of individual cutting wheels having a toothed outer periphery and a central bore adapted to closely receive the axle therethrough, and a plurality of spacers having a center bore adapted to closely receive said axle, said spacers being interposed between said cutting wheels to provide separation of said cutting wheels, said cutting wheels and said spacers being rotatably disposed along said axle.

10. The resurfacing disk defined in claim 9 in which the spacers comprise flat washers.

11. The resurfacing disk defined in claim 9 in which the cutting teeth are made of a material chosen from the set consisting of hardened steel and carbide.

12. The resurfacing disk defined in claim 9 in which the rotary cutters are made from sheet steel.

13. A resurfacing disk removably mountable to a downwardly extending rotatable disk mount having a plurality of downwardly open mounting pin holes of a rotary floor resurfacing machine to remove material from a floor surface, comprising:

a substantially rigid upper disk having respective upper and lower surfaces, said upper surface which includes a plurality of counterbored holes;

a plurality of resilient replaceable grommets each including a longitudinal bore, an upper end, a middle flange of a larger outer size than the upper end thereof, and a lower end adapted to removably mount to said upper surface of said upper disk, said middle flange and said lower end being closely received in said counterbored holes;

a retaining device comprising a retaining plate with a plurality of holes which correspond to said counterbored holes in said upper disk; said retaining plate being removably mountable to said upper surface of said upper disk to retain said grommets to said upper disk; and wherein said upper end of each grommet closely passes through one of the holes in the retaining plate;

a plurality of mounting pins each including an upper end adapted to closely fit within a corresponding mounting pin hole of the disk mount and a lower end detachably engageable within said longitudinal bore of one of said grommets;

at least one floor resurfacing device removably mounted to said lower surface depending downwardly therefrom adapted for removing the material from the floor surface as said resurfacing disk moves thereon; and wherein said grommets are individually deformable to permit said resurfacing device to more closely follow the contours of the floor surface.

14. The resurfacing disk defined in claim 13 further comprising a resiliently deformable lower disk mounted to the lower surface of the upper disk, the floor resurfacing device being removably mounted to a lower surface of said lower disk depending downwardly therefrom, said lower disk deforming to permit said floor resurfacing devices to more closely follow contours of the floor surface.

15. The resurfacing disk defined in claim 14 in which the lower disk comprises a semi-rigid, hard sponge.

16. The resurfacing disk defined in claim 14 in which the floor resurfacing devices each comprise a sanding disk which includes a sandpaper disk having a rough sanding surface for engaging the floor surface and a smooth back surface removably affixable to the lower surface of the lower disk.

17. The resurfacing disk defined in claim 14 in which the floor resurfacing devices are removably affixable to the lower surface of the lower disk using respective sheets of an interconnectable hook and a loop fastener material affixed the lower surface of the lower disk and to a back surface of the floor resurfacing devices.

18. The resurfacing disk defined in claim 14 in which the retaining plate includes a centering post which closely fits within a centering hole of the upper disk, there are four mounting pins and grommets for use with disk mounts having four corresponding mounting pin holes disposed in a square pattern, and the upper disks include four pin receiving holes in a square pattern corresponding to the disk mount, the mounting pins, the pin receiving holes of the disk mounts, and the longitudinal bore of the grommets are all of a circular cross-section.

19. A resurfacing disk removably mountable to a downwardly extending rotatable disk mount having a plurality of downwardly open mounting pin holes of a rotary floor resurfacing machine to remove material from a floor surface, comprising:

a substantially rigid upper disk having respective upper and lower surfaces, said upper surface which includes a plurality of counterbored holes;

a resiliently deformable lower disk mounted to the lower surface of the upper disk, a plurality of resilient replaceable grommets each including a longitudinal bore, an upper end adapted to removably mount to the disk mount, a middle flange of a larger outer size than the upper end thereof, and a lower end adapted to removably mount to said upper surface of said upper disk, said middle flange and said lower end being closely received in said counterbored holes and retained thereto by at least one retaining device comprising a retaining plate with a plurality of holes which correspond to said counterbore holes in said upper disk adapted to closely pass said upper ends of said grommets, said retaining plate being removably mountable to said upper surface of said upper disk to retain said grommets to said upper disk;

a plurality of mounting pins each including an upper end adapted to closely fit within a corresponding mounting pin hole of the disk mount and a lower end detachably engageable within said longitudinal bore of said grommets; and in which the lower ends of the mounting pins include an annular groove adapted to receive an external retaining clip, and the lower ends of the grommets are slotted to accommodate said retaining clips; and at least one floor resurfacing device removably mounted to said lower surface of said lower disk depending downwardly therefrom and adapted for removing the material from the floor surface as said resurfacing disk moves thereon; and wherein said lower disk and said grommets deform to permit said floor resurfacing device to more closely follow the contours of the floor surface.

20. The resurfacing disk defined in claim 13 in which the floor resurfacing devices comprise rotary cutters each including a bracket mountable to the lower surface of the lower disk, and a generally cylindrical cutter rotatably mounted to said bracket having a plurality of radially extending cutting teeth disposed about a rotational axis which is oriented radially outwardly from the resurfacing disk axis so as to rotate therearound during resurfacing disk rotation.

21. The resurfacing disk defined in claim 20 in which the brackets include a base plate and a pair of downwardly dependent tabs having respective holes therethrough, the rotary cutter being mounted thereto on an axle which extends through said tabs and said rotary cutter.

22. The resurfacing disk defined in claim 20 in which the rotary cutters include a plurality of individual cutting wheels having a toothed outer periphery and a central bore adapted to closely receive the axle therethrough, and a plurality of spacers having a center bore adapted to closely receive said axle, said spacers being interposed between said cutting wheels to provide separation of said cutting wheels, said cutting wheels and said spacers being rotatably disposed along said axle.

23. The resurfacing disk defined in claim 22 in which the cutting teeth are made of a material chosen from the set consisting of hardened steel and carbide.

24. The resurfacing disk defined in claim 1, wherein each hole is counterbored into the upper surface of the upper disk and has a narrower portion and a wider portion; and wherein the lower end of each grommet includes a lowermost end of a first diameter and a middle flange of a greater diameter; and wherein the lowermost end of the grommet is tightly received within the narrower portion of the hole and the middle flange is tightly received within the wider portion of the hole.

25. The resurfacing disk defined in claim 24, wherein each grommet further includes an uppermost end which extends upwardly and outwardly away from the upper surface of the upper disk when the grommet is received within the counterbored hole.

26. The resurfacing disk defined in claim 25, further comprising a retaining plate mounted on the upper surface of the upper disk; the retaining plate defining a plurality of apertures therein, the apertures being aligned to the positions of the holes in the upper disk.

27. The resurfacing disk defined in claim 26, wherein the upper disk further includes a centering aperture disposed at the center of the upper disk; and the retaining plate further includes a downwardly extending centering flange disposed at the center of the plate; and wherein the centering flange is complementary sized and shaped to be received within the centering aperture in the upper disk.

* * * * *